US007014686B2

(12) United States Patent
Gatchell et al.

(10) Patent No.: US 7,014,686 B2
(45) Date of Patent: Mar. 21, 2006

(54) ELECTROSTATIC AIR CLEANER

(75) Inventors: Stephen M. Gatchell, Warwick, RI (US); Chi-Hsiang Wang, Taipei (TW)

(73) Assignee: Kaz, Inc., New York, NY (US)

( * ) Notice: Subject to any disclaimer, the term of this patent is extended or adjusted under 35 U.S.C. 154(b) by 0 days.

(21) Appl. No.: 10/794,526

(22) Filed: Mar. 4, 2004

(65) Prior Publication Data

US 2004/0168574 A1 Sep. 2, 2004

Related U.S. Application Data

(62) Division of application No. 10/267,006, filed on Oct. 8, 2002.

(51) Int. Cl.
*B03C 3/74* (2006.01)

(52) U.S. Cl. ..... 96/51; 96/96

(58) Field of Classification Search ..... 96/16, 96/39, 51, 63, 70–72, 76, 94, 96, 98; 95/76, 95/78; 55/DIG. 38
See application file for complete search history.

(56) References Cited

U.S. PATENT DOCUMENTS 1,204,907 A * 11/1916 Schmidt ..... 96/96
1,393,712 A * 10/1921 Steere et al. ..... 95/73
1,396,811 A * 11/1921 Chubb ..... 95/77
1,605,648 A * 11/1926 Cooke ..... 95/79
2,592,508 A * 4/1952 Phyl ..... 96/98
2,711,225 A * 6/1955 Armstrong et al. ..... 96/62
3,765,154 A * 10/1973 Hardt et al. ..... 96/88
4,147,522 A * 4/1979 Gonas et al. ..... 95/68
4,233,037 A * 11/1980 Pontius et al. ..... 95/79
4,259,093 A * 3/1981 Vlastos et al. ..... 96/76
4,284,420 A * 8/1981 Borysiak ..... 96/40
4,318,718 A * 3/1982 Utsumi et al. ..... 96/51
4,354,858 A * 10/1982 Kumar et al. ..... 95/78
4,789,801 A * 12/1988 Lee ..... 310/308
5,137,546 A * 8/1992 Steinbacher et al. ..... 95/71
5,492,557 A * 2/1996 Vanella ..... 96/16
5,993,738 A * 11/1999 Goswani ..... 422/22
6,149,717 A * 11/2000 Satyapal et al. ..... 96/16
6,176,977 B1 * 1/2001 Taylor et al. ..... 204/176
6,238,451 B1 * 5/2001 Conrad et al. ..... 55/323
6,294,003 B1 * 9/2001 Ray ..... 96/49
6,322,614 B1 * 11/2001 Tillmans ..... 96/16
6,348,103 B1 * 2/2002 Ahlborn et al. ..... 134/6
6,350,417 B1 * 2/2002 Lau et al. ..... 422/186.04
6,368,391 B1 * 4/2002 O'Hara et al. ..... 96/18
6,372,131 B1 * 4/2002 Mirowsky et al. ..... 210/205
6,616,736 B1 * 9/2003 Massey et al. ..... 96/25

* cited by examiner

*Primary Examiner*—Richard L. Chiesa
(74) *Attorney, Agent, or Firm*—Darby & Darby, P.C.

(57) ABSTRACT

An air cleaner electrode assembly includes an elongated collector electrode and a plurality of elongated discharge electrodes arranged around the collector electrode. A fan may move air in a direction parallel to a length of the electrodes. The collector electrode may have a plurality of distinct faces where at least one discharge electrode is associated with a corresponding face. A cleaning shuttle may be configured to ride on and remove debris from the elongated electrodes. A voltage differential across the electrodes and the fan speed may be adjusted independently of each other.

28 Claims, 7 Drawing Sheets

ELECTROSTATIC AIR CLEANER

The present application is a divisional of U.S. application Ser. No. 10/267,006 filed Oct. 8, 2002, which claims priority therefrom, under 35 U.S.C. §119(e). The application is hereby incorporated by reference in its entirety.

FIELD OF THE INVENTION

This invention relates to electrostatic air cleaners.

BACKGROUND OF THE INVENTION

Electrostatic precipitation is a widely used method for cleaning gasses, having long been used in large scale industrial applications. The fundamental design of electrostatic precipitators remained largely unchanged for years. In a typical application, seen, for example, in U.S. Pat. No. 1,204,907, a high voltage electrode was placed in the center of a grounded tube. The high voltage caused corona discharge between the discharge electrode and the grounded tube which imparted an electrostatic charge to particles in a gas between the discharge electrode and the grounded tube. The charged particles were then precipitated electrostatically onto the surface of the grounded tube, resulting in cleaner gas. While effective, this arrangement necessitated relatively large structures and had the disadvantage of being difficult to clean.

Recent efforts have been directed at adapting electrostatic gas cleaning technology to personal air cleaners sized for use in the home. An example of these efforts can be found in U.S. Pat. No. 6,176,977. This patent is directed to so-called "electro-kinetic" technology. Electro-kinetics takes advantage of the air movement produced by a very high voltage differential across two porous electrode arrays. As with traditional electrostatic precipitation, the voltage differential causes charged particles and surrounding air molecules to move in the direction of the grounded or negatively charged electrode. As the charged particles and air molecules pass through the porous second array of electrodes, which removes some of the particles from the air, at least a portion of the air molecules retain their momentum, resulting in a flow of air past the second array. The displacement of the air causes more air to be drawn into the space between the arrays, and the cycle continues.

SUMMARY OF THE INVENTION

In one illustrative embodiment, the present invention provides an electrostatic air cleaner that is small in size, requires only moderate voltage levels, and is relatively easy to manufacture.

In one aspect of the invention, an air cleaner electrode assembly includes an elongated collector electrode and a plurality of elongated discharge electrodes arranged around the collector electrode. In one illustrative embodiment, a fan moves air relative to the electrodes. In another embodiment, air moves in a direction parallel to a length of the electrodes. In another embodiment, the collector electrode has a plurality of distinct faces and at least one discharge electrode is associated with a corresponding face.

In another aspect of the invention, a portable air cleaner includes a housing having an interior passageway, an elongated first electrode disposed within the passageway, a plurality of second electrodes arranged in the passageway around the collector electrode, and a fan configured to move air in a direction parallel to the longitudinal length of the first electrode.

In another aspect of the invention, a portable air cleaner includes a housing having an air inlet and an air outlet, a fan arranged to draw air in through the air inlet and expel air out through the air outlet, a collector electrode disposed between the air inlet and the air outlet, a plurality of elongated discharge electrodes arranged around the collector electrode, and electrical circuitry configured to provide a first voltage level to the discharge electrodes and a second voltage level to the collector electrode.

In another aspect of the invention, a method of electrostatically cleaning air includes providing a plurality of elongated discharge electrodes around a single collector electrode, wherein the collector electrode has a plurality of elongated concave faces, each of which corresponds to one of the discharge electrodes; creating a substantial voltage differential between the discharge electrodes and the collector electrode; and moving air along the length of discharge and collector electrodes.

In another aspect of the invention, a portable air cleaner includes a portable housing having an air inlet, an air outlet, and an elongated passageway connecting the air inlet and the air outlet; a hollow, elongated first electrode disposed within the passageway and having a plurality of distinct faces; a plurality of elongated second electrodes arranged in the passageway around the collector electrode, each second electrode corresponding to at least one distinct face; electrical circuitry configured to provide a first voltage level to the first electrode and a second voltage level to the second electrodes; and a fan configured to move air in through the air inlet, along a longitudinal length of the first and second electrodes, and out through the air outlet.

In another aspect of the invention, an electrode cleaner includes a housing, a plurality of elongated electrodes arranged in the interior of the housing, and at least one loose cleaning shuttle that is configured to ride on and remove debris from at least two of the elongated electrodes.

A method of electrostatically cleaning air including providing a first set of electrodes and a second set of electrodes; establishing a voltage differential across the first and second sets of electrodes; providing a fan constructed and arranged to move air past the first and second sets of electrodes; and controlling one of the voltage differential and the fan speed independently of the other of the voltage differential and the fan speed.

These and other aspects of the present invention will be apparent from the following detailed description and the appended claims.

BRIEF DESCRIPTION OF THE DRAWINGS

Illustrative embodiments in accordance with aspects of the invention are described below in conjunction with the following drawings in which like numerals reference like elements and wherein.

DETAILED DESCRIPTION

Various embodiments in accordance with the invention may be used to clean particulate matter from various gasses or gas mixtures. In certain embodiments, air cleaners according to the invention may be used in a house, garage, office, or similar environment to clean air. Certain embodiments also have the benefit of a small size which allows them to not take up much space in the room or other environment being cleaned. Air cleaners according to the invention may also be sized to be portable, i.e., carried by hand and selectively placed within a space the air of which is desired to be cleaned.

Figure 1:
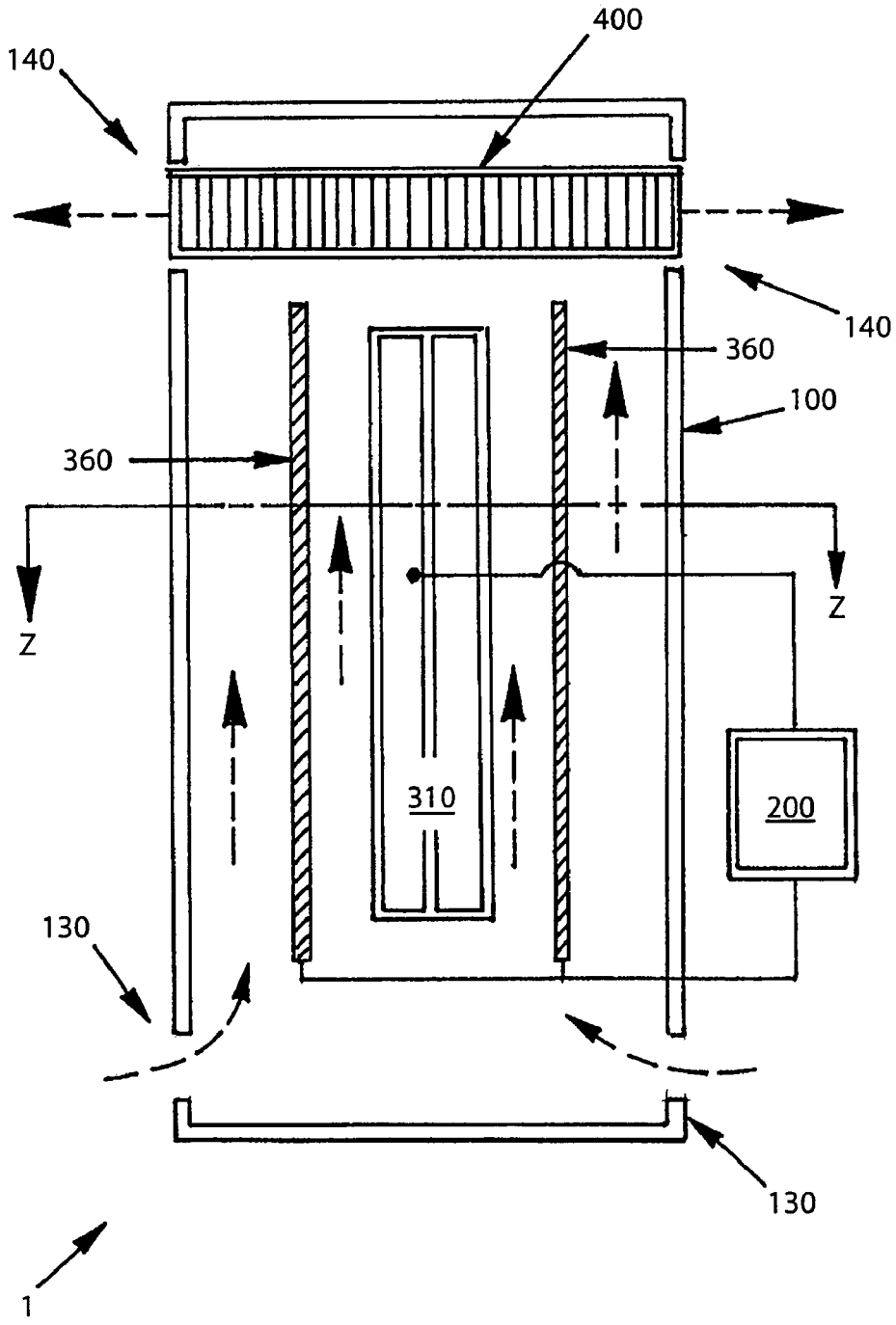
FIG. 1 is a schematic view of an air cleaner in accordance with an aspect of the invention.
Figure 2:
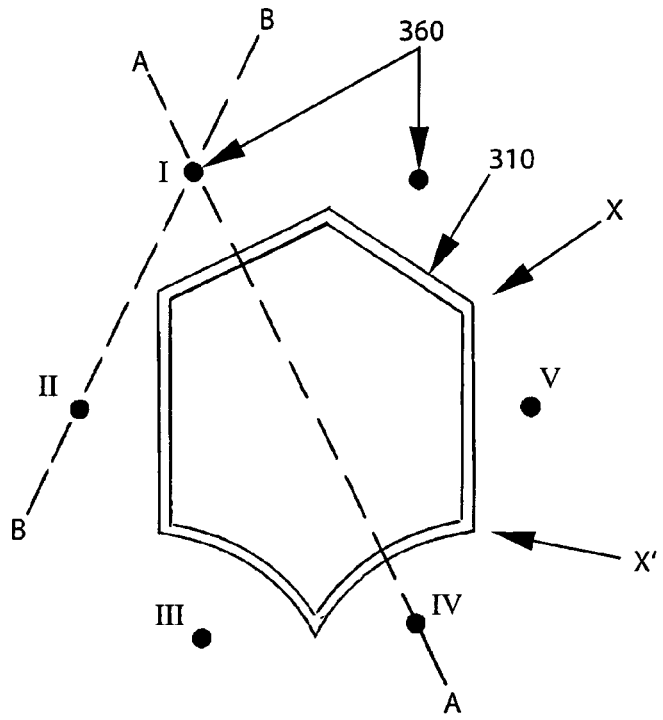
FIG. 2 is a partial cross-sectional view of the air cleaner of FIG. 1, taken along line Z—Z.

FIG. 1 shows a schematic view of an illustrative embodiment of an air cleaner 1 in accordance with the invention. In this embodiment, the air cleaner 1 has a housing 100 that includes air inlets 130 and air outlets 140, power supply circuitry 200, a collector electrode 310 connected to a first output of the power supply circuitry 200, a plurality of discharge electrodes 360 connected to a second output of the power supply circuitry 200, and a fan 400. FIG. 2 shows a cross-section of the collector electrode 310 and discharge electrodes 360 taken along line Z—Z in FIG. 1.

The fan 400 draws air into the housing 100 through the air inlets 130, through the body of the housing 100, and then expels air out through the air outlets 140. The general direction of the air flow through the air cleaner 1 is illustrated in FIG. 1 by dashed arrows. Collector electrode 310 and discharge electrodes 360 are located within the housing 100 such that the air passes them as it is moved through the air cleaner 1 by the fan 400. The power supply circuitry 200 of this embodiment is connected to the collector 310 and the discharge electrodes 360 and creates a voltage differential between the collector electrode 310 and the discharge electrodes 360. As the air passes through the housing 100, particulate matter in the air is given a charge by the discharge electrodes 360. The charged particles are then repelled by the discharge electrodes 360 and attracted to the collector 310, causing them to move in the direction of the collector electrode 310 and become deposited on its surface, a process known as "precipitation," resulting in cleaner air with fewer suspended particulates. The cleaned air is then drawn through the fan 400 and expelled from the housing 100.

In one aspect of the invention, an air cleaner may employ a single, central collector electrode. A single electrode may provide a large surface area conducive to the collection of particulate matter. A single collector electrode may also be more easily removed for cleaning or replacement than would be possible with a number of separate structures, like a series of rods, sheets, or rings. A single collector electrode may also allow for a more compact air cleaner, permitting, for example, an air cleaner to be constructed with a small footprint. A single collector electrode may also be easier and less expensive to fabricate than would be a number of separate structures, may more easily be replaced if damaged, and may result in a more easily and inexpensively manufactured air cleaner.

In another aspect of the invention, the collector electrode may be removed for cleaning. Upon removal from the air cleaner, the single collector electrode may be cleaned by a simple wiping of its surfaces, an efficient method of cleaning in view of the large amount of particulate matter that may accumulate. Manual cleaning may also allow the user to appreciate the quantity of particulate matter being removed from the air.

In another aspect of the invention, a collector electrode may be provided with a number of distinct faces, such as those shown in the cross-section shown in FIG. 2. The distinct faces may cooperate with one or more discharge electrodes so as to increase the efficiency of the air cleaner by providing for a more even collection of particulate matter on the surface of the collector electrode. The distinct faces may be defined by a physical change in the surface of the collector, e.g., an indentation, ridge, corner, gap, or edge, or they may be defined simply by their functional relationship to a discharge electrode. In some embodiments, the distinct faces may be theoretical segments of a smooth surface such as a cylinder. Some or all of the distinct faces may have a single flat surface, may have any number of flat sub-faces, may have a constant or variable radius, and/or may be partially curved and partially flat. In short, the faces may be shaped in any suitable way. The collector electrode illustrated in FIG. 2, for example, has four flat distinct faces and two curved distinct faces. In some embodiments, the distinct faces may not cover the entire surface of the collector electrode.

In another aspect of the invention, distinct faces of a collector electrode may be concave. The use of concave faces on a collector electrode may allow the individual discharge electrodes to be more uniformly spaced from the surface of the distinct face with which they cooperate. The more uniform spacing may allow for a more uniform deposition of precipitated particulate matter on the surface of the collector which, in turn, may result a more efficient air cleaner and longer times between cleanings. The collector electrode shown in FIG. 2 has two concave faces.

In another aspect of the invention, a collector electrode may be hollow, thereby reducing its weight and the weight of the unit as a whole. For example, the collector electrode may be formed as an elongated tube having a cross-section such as that shown in FIG. 2. A hollow collector electrode may also be more easily and inexpensively manufactured than a solid collector electrode.

In another aspect of the invention, a collector electrode may be hollow with perforated walls. With a perforated collector electrode, the air cleaner may be configured such that the air may move through the walls of the collector electrode and then up or down through its hollow center and out of the air cleaner. Such air flow may be created by a fan, by electro-kinetics, by some combination of both, or by any other suitable method or combination of methods. Perforations may also reduce the weight of the collector electrode. It should be appreciated that "up" and "down," as used in this context and in the claims, are relative terms used only to denote different portions of the air cleaner; one or both terms may refer to any portion the air cleaner and may include one or more of a top, bottom, front, back, or side.

In another aspect of the invention, an air cleaner may employ a plurality of discharge electrodes arranged around a collector electrode. "Around," as it is used in this context and in the claims, means that a straight line can be constructed from at least one discharge electrode to at least one other discharge electrode such that the line passes through the collector electrode. This relationship is illustrated in FIG. 2, which shows six discharge electrodes 360 are arranged "around" the collector electrode 310, as straight line A—A, drawn between discharge electrodes I and IV, must pass through the collector electrode. Notably, the set of discharge electrodes 360 is "around" the collector electrode 310 even though a straight line can be drawn between two electrodes that does not pass through the collector, such as line B—B in FIG. 2. Discharge electrodes are "around" a collector electrode if it is possible to construct a straight line connecting any points along the lengths of any two discharge electrodes that also passes through the collector electrode. The use of multiple discharge electrodes located around the single collector electrode may allow for a more compact air cleaner, as the electrodes may be arranged in the relatively tight form of a cylinder allowing, for example, for an air cleaner to be constructed with a small footprint. Multiple discharge electrodes may also facilitate the use of a single, central collector electrode and may promote even deposition of precipitated particulate matter.

In another aspect of the invention, one or more discharge electrodes may correspond to one or more distinct faces of the collector electrode. The distinct faces may cooperate with one or more discharge electrodes so as to increase the efficiency of the air cleaner by providing for even collection of particulate matter on the surface of the collector electrode.

In another aspect of the invention, a discharge electrode may be centered with respect to a distinct face of the collector electrode. By "centered" it is meant that a longitudinal axis of a discharge electrode is approximately equidistant from the longitudinal boundaries of the distinct face. In FIG. 2, for example, discharge electrode V is centered in the corresponding distinct face bounded by edges X and X'. Centering a discharge electrode with respect to a distinct face may promote a more uniform deposition of particulate matter.

In another aspect of the invention, a discharge electrode may be parallel to a distinct face of the collector electrode. By "parallel" it is meant that all points along the length of a discharge electrode are approximately the same distance from the distinct face. Arranging a discharge electrode parallel to a distinct face may also promote a more uniform deposition of particulate matter.

In another aspect of the invention, a discharge electrode may be equidistant from a distinct face of the collector electrode. By "equidistant" it is meant that, at any given longitudinal position on the discharge electrode, all points on the distinct face are approximately the same distance from the discharge electrode. Arranging a discharge electrode equidistant to a distinct face may also promote a more uniform deposition of particulate matter.

In another aspect of the invention, a fan may be used to provide at least some of the air flow through the air cleaner. Use of a fan to move air through the unit has numerous advantages. For example, as compared to the use of a voltage differential, use of a fan to move air may require less power. A substantial amount of power is required to maintain the high voltage required to create sufficient "electro-kinetic" flow to move a meaningful amount of air through an electro-kinetic cleaner, resulting in a unit with a relatively high cost of operation. Modern fans, on the other hand, are inexpensive to operate. The circuitry and structures required to maintain a voltage level sufficient for electro-kinetic flow may also be more expensive to manufacture than that required with a fan. The higher voltages required to create electro-kinetic flow may also present an enhanced danger of electric shock, necessitating additional safeguards.

The use of a fan to move air through the unit may also allow more control over the air cleaning process. Electro-kinetic devices generally increase the flow of air through the unit by increasing the voltage differential across two electrode arrays. Accordingly, air flow and the level of precipitation are tied together; increasing the voltage level to the electrode arrays increases the air flow and particulate deposition and vice versa. By using a fan that operates independently of the electrodes, on the other hand, the user may tailor the level of precipitation and air flow to best suit the environment in which the air cleaner is being used. Thus, for example, the fan speed may be set to a low setting and the electrode voltage differential to a high setting, thereby cleaning a smaller amount of air more thoroughly, or the fan may be set to a high speed and the voltage differential to a lower setting, thereby providing a lighter cleaning to a larger amount of air. This arrangement also allows for more control over power consumption. Additionally, because the fan and precipitating functions are separate, the electrodes may be shut off entirely and the unit operated as fan alone.

Notwithstanding the fact that fans may provide certain advantages, it should be understood that the invention includes within its scope electrode assemblies and air cleaners that do not require the use of a fan. In one embodiment, for example, the air flow past the electrodes is wholly or partially created by electro-kinetics.

In another aspect of the invention, air may be moved in a direction parallel to the length of an elongated collector electrode. Movement of air along the length of the collector electrode may provide more surface area for precipitation than other arrangements such as, for example, configurations in which the air is moved perpendicular to the length of the collector electrode. An air cleaner configured to move air in a direction parallel to the length of the collector electrode may also be more compact that would be an air cleaner arranged in another fashion.

In another aspect of the invention, the air inlets and air outlets may be located at opposing ends of the collector electrodes. Locating the air inlets and air outlets in this fashion allows the air to travel along the length of the collector and discharge electrodes, providing more surface area for precipitation, as noted. In some embodiments, however, the air inlets and air outlets may be located in other portions of housing. For example, provided that the fan is configured to direct the air flow appropriately, the air inlets and/or air outlets may be located at the other of the top or bottom of the housing, or in the middle of the housing.

In another aspect of the invention, the air inlets may be located near the base of the unit and the air outlets may be located near the top of the unit. This configuration may reduce the possibility that air being moved by the air cleaner will stir up particulate matter resting on surfaces located near the bottom of the cleaner and may more efficiently distribute cleaned air throughout the room.

In another aspect of the invention, the housing of the air cleaner may be portable and/or may be sized to be carried by hand. A portable or hand carriable housing may allow the air cleaner to be easily moved from room to room as needed. In other embodiments, however, the air cleaner may not be portable, being installed in or on, for example, a floor, a wall, ducting, or any other immobile surface or object.

In another aspect of the invention, discharge and/or collector electrodes may be cleaned by one or more shuttles that may ride on one or more of the electrodes. Cleaning the electrodes by means of a shuttle rather than, for example, by hand, may protect delicate discharge electrodes and prevent the user from coming into contact with potentially high residual voltages. In some embodiments, the shuttles may be "loose," meaning not fixedly attached to the collector electrode or the housing. In some embodiments, the shuttles may rest at the bottom of the air cleaner during normal operation of the air cleaner, but may be moved up and down on the electrodes by inversion or shaking of the housing. In some embodiments, the shuttles may be bead-shaped. In some embodiments, the air cleaner may be adapted to mate with a portion of a standard household vacuum cleaner for the purpose of collecting from the air cleaner particulate matter removed from the electrodes by the shuttles.

In another aspect of the invention, the air cleaner housing may be elongated and oriented vertically. This arrangement may facilitate the directing of air along the length of the collector electrode and/or discharge electrodes, give the unit a small footprint and an aesthetically pleasing appearance, and permit the controls to be conveniently located on the top of the unit.

In another aspect of the invention, the discharge and collector electrodes may be energized by power supply circuitry that converts current from any power source, including ordinary household current, any type of battery, and automobile outlets, to high voltage direct current. "Power supply circuitry," as used here and in the claims, means electrical circuitry configured to provide appropriate power to the discharge and collector electrodes and, in some cases, the fan; "power supply circuitry" does not require the circuitry to produce actual electrical current or other power, nor does it require the actual presence of current or other power. In some embodiments, the discharge electrodes may all be supplied with the same voltage level, while, in other embodiments, the discharge electrodes may be supplied with one or more different voltage levels.

In another aspect of the invention, an air cleaner may be provided with one or more supplemental methods of cleaning the air in addition to precipitation. In some embodiments, for example, an air cleaner may have an ultraviolet light and/or a mechanical filter configured to treat some or all of the air passing through the air cleaner.

In another aspect of the invention, a collector electrode may be connected to the power supply circuitry by means of a leaf-type spring. The leaf-type spring may allow easy removal of the collector, yet provide a reliable electrical connection. In some embodiments, the collector electrode may be provided with a handle to facilitate removal from and insertion into the cleaner and/or the housing may have a hinged top portion to conceal the collector electrode and handle and reduce the possibility that the collector might be removed inadvertently.

In another aspect of the invention, the housing is provided with controls that allow the user to control operation of the air cleaner. In various embodiments, the controls might allow the unit to be turned on and off, the fan speed to be adjusted, the electrode voltages to be adjusted, and/or might provide visual or other feedback concerning the status of various settings.

FIGS. 3–9 show a particular illustrative embodiment of an air cleaner 1 in accordance with the invention. This embodiment is a portable air cleaner intended for use in a home, office, or similar situation.

In this illustrative embodiment, the air cleaner 1 has a housing 100, as can be seen in FIGS. 3–6. The housing 100 has a body 110 that is formed of a front body shell 110*a*, a rear body shell 110*b*, a body top 110*c* (shown in FIG. 6), and a body base 110*d* (shown in FIG. 6). The housing 100 also has a lid 120 formed of a front lid shell 120*a*, a rear lid shell 120*b*, a lid top 120*c*, and a lid bottom 120*d* (shown in FIG. 6). The lid 120 is rotably attached to the body 110 by cooperating hinge portions 115 and 125, which are joined by pins 127. While the lid 120 of this embodiment provides the air cleaner 1 with a neat appearance by concealing the removable collector 310 (shown in FIG. 6), it should be understood that the lid 120 is not critical to the invention and that the housing can consist solely of the body 110. Of course, while the body 110 of this embodiment is formed of four parts, the body 110 can be made of any number of parts, including one. In addition, while the housing 100 of this illustrative embodiment is formed of molded ABS plastic, the housing 100 can be formed of any suitable material and can be formed in any appropriate manner.

The housing 100 of this embodiment has a number of interior and exterior details on both the body 110 and the lid 120, including, for example, front and rear ribs 112, side hand grips 114, and rear hand hold 116. The shapes of the interior and exterior surfaces of housing 100 are not critical, however. These surfaces can have any type of interior and/or exterior decoration or design, including ribs, protrusions, indentations, slots, and other structures, as well as any suitable textures or colors.

Figure 5:
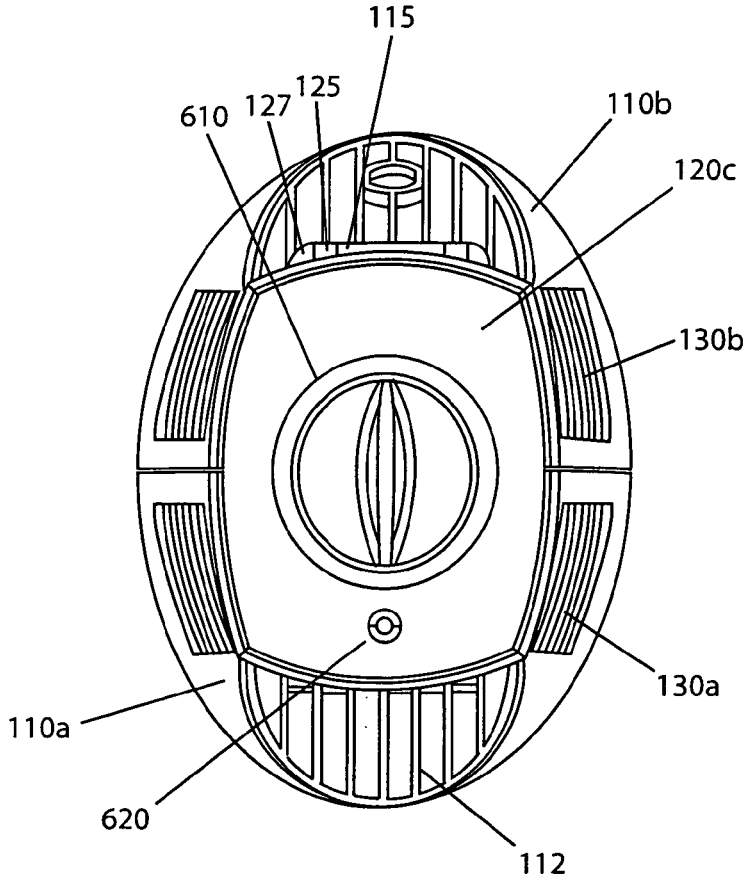
FIG. 5 is top view of the FIG. 3 air cleaner.

In this embodiment, the housing 100 has a long axis that is oriented vertically. The vertical arrangement facilitates the direction of air along the length of the air cleaner 1, gives the unit a small footprint and an aesthetically pleasing appearance, and permits the controls to be conveniently located on the top of the unit. The housing 100 of this embodiment has an elliptical footprint that tapers gradually upwards to a cross-section that has the shape of a rectangle with slightly bulging sides, as seen in FIG. 5. Although this design has been found to be functional and aesthetically pleasing, it should be understood that other overall shapes, orientations, and cross-sectional designs may be employed. For example, the housing 100 may be oriented with its long axis in a horizontal direction, may be squat in overall appearance, and/or may have a cross-section that is approximately square, rectangular, circular, elliptical, or that is any combination of these or other shapes.

The housing 100 is sized to enclose the various components of the air cleaner 1, including the power supply circuitry 200, the collector and discharge electrodes 310, 360, and the fan 400, and to allow sufficient air flow through the air cleaner 1. It should be understood, however, that certain of these components, including the power supply circuitry 200, the collector and discharge electrodes 310, 360, and the fan 400, may be located wholly or partially outside the housing.

This illustrative embodiment has a housing 100 that is approximately 680 millimeters (mm) tall, has a footprint that is approximately 170 mm wide and 200 mm deep, and is approximately 108 mm wide and 130 mm deep at the mid-point of its height. Of course, the overall shape and these dimensions may vary depending on the size and shape of the power supply circuitry 200, the collector and discharge electrodes 310, 360, and the fan 400 chosen for a particular application. In one embodiment, for example, the air cleaner 1 can be taller with approximately the same footprint and width, so as to facilitate the inclusion of a longer collector and discharge electrodes 310, 360.

Air inlets 130 in this illustrative embodiment are located on the lower portion of housing 100. In this embodiment, front air inlets 130*a* are located on the lower portions of the rear body shell 110*b*. In other embodiments, however, the air inlets 130 may be located in other portions of housing. For example, the air inlets 130 could be located at the top of the housing 100. The air inlets 130 could also be situated within or surrounded by the collector 310, provided that the fan 400 was configured to direct the air flow appropriately. The shape and size of air inlets 130 may be determined according to the quantity of air desired to be cleaned and by the overall configuration of the air cleaner 1.

This illustrative embodiment also includes air outlets 140 located on the front lid shell 120*a*. In this position, the air outlets 140 are in registration with the outlet of the scroll 425 of the fan 400. It has been found advantageous to locate the air outlets 140 on the upper portion of the housing 100 because the outlet of air at the upper portion of the housing is less likely to stir up particulate matter that has settled on surfaces adjacent to the bottom of the air cleaner 1 and because a higher air outlet 140 allows cleaned air to be better circulated throughout the volume of the air being cleaned. The air outlets 140 may, however, be located in other portions of housing. For example, the air outlets 140 could be located at the bottom of the housing 100 or, like the air inlets 130, the air outlets 140 could also be situated within or surrounded by the collector 310, provided that the fan 400 was configured to direct the air flow appropriately. The shape and size of air outlets 140 may be determined according to the quantity of air desired to be cleaned and by the overall configuration of the air cleaner 1.

Figure 6:
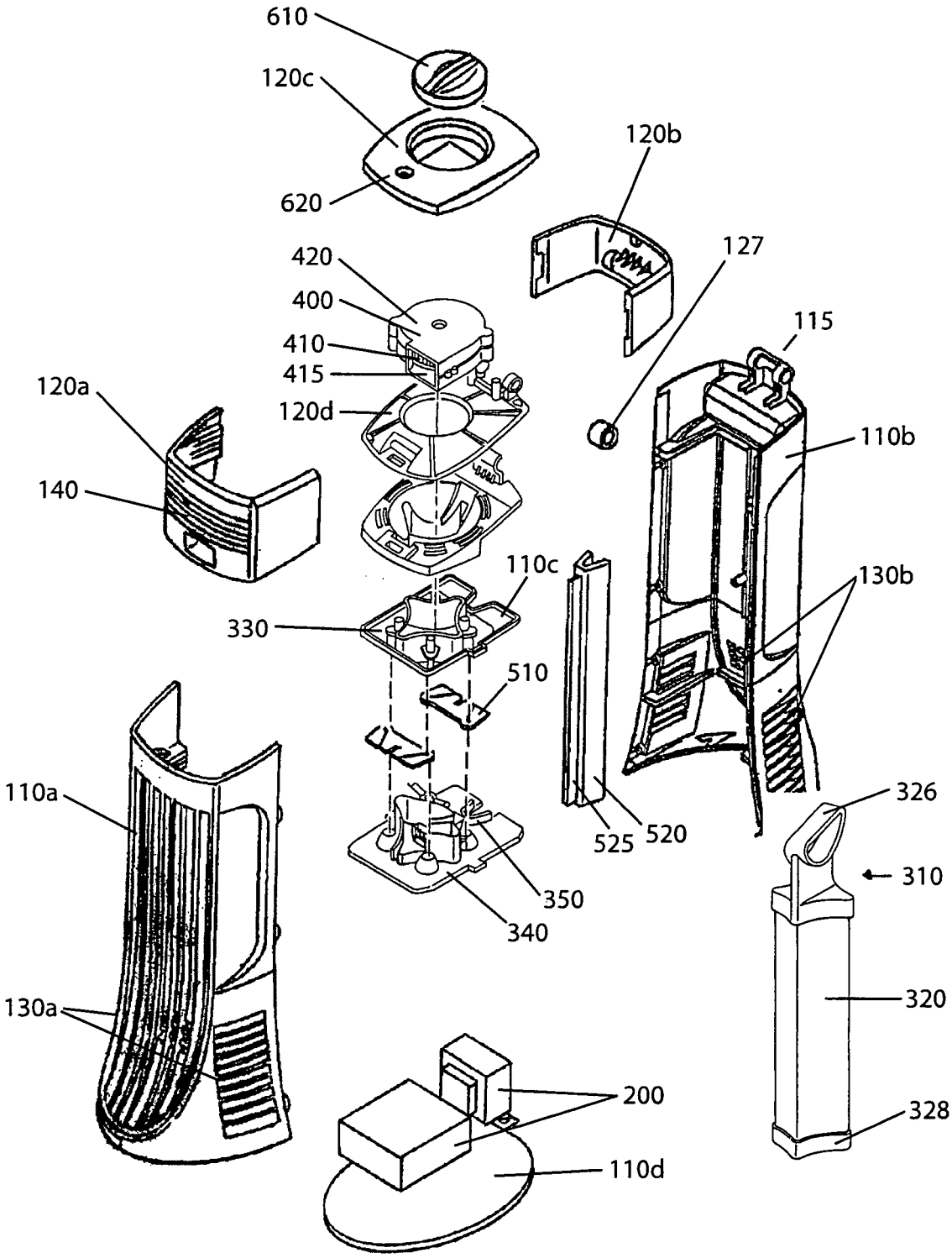
FIG. 6 is an exploded perspective view of the FIG. 3 air cleaner.

As can be seen in FIG. 6, the air cleaner 1 of this embodiment includes power supply circuitry 200 which provides power to the collector and discharge electrodes 310, 360 and the fan 400. The power supply circuitry 200 of this embodiment converts ordinary 120 volt alternating current, or other standard household current, to low voltage direct current to power the fan 400. Such an embodiment may thus be used in any location in which ordinary household current is available. The nature of power supplied to the fan 400 is not critical, however, and can vary depending on the nature of the fan 400 chosen. The power supply circuitry 200 also converts ordinary 120 volt alternating current, or other standard household current, to high voltage direct current to be supplied to the discharge electrodes 360 and the collector electrode 310. In the illustrative embodiment, the voltage supplied to the discharge electrodes 360 may be on the order of approximately 3,000 to approximately 20,000 volts (relative to ground), preferably 7000 volts, and the voltage supplied to the collector 310 may be on the order of approximately −3,000 to approximately −20,000 volts (relative to ground), preferably −7000 volts. The absolute values of the voltages are not critical, however, and the values may differ, provided that the difference between the discharge electrode voltage and the collector voltage is on the order of approximately 6,000 to approximately 40,000 volts, preferably 14,000 volts. In the air cleaner of the illustrated embodiment, for example, the collector electrode 310 could be a ground or otherwise at a relative zero voltage and the discharge electrodes 360 could be at approximately 14,000 volts. In another embodiment, the collector electrode 310 could be at approximately 14,000 volts and the discharge electrodes 360 could be a ground or otherwise at a relative zero voltage. In some embodiments, the air cleaner 1 may be configured to allow the voltage levels to be adjusted, either together or independently.

It should be understood that the voltage levels listed above are appropriate for the geometry of the illustrated embodiment of the air cleaner and that other geometries may require that the voltage levels be adjusted. For example, a lower voltage differential may be appropriate in an embodiment in which the discharge electrodes 360 are closer to the collector electrode 310, while a higher voltage differential might be appropriate where the discharge electrodes 360 and the collector 310.

In some embodiments, the voltage differential may result in the generation of ozone. Ozone is created when electrical discharge between the discharge electrodes 360 and the collector electrode 310 splits oxygen molecules ($O_2$) in the air passing through the housing 100 and the individual oxygen atoms then combine with other oxygen molecules to form ozone ($O_3$). In certain concentrations, ozone has beneficial effects, such as removal from air of odors such as those associated with tobacco or other smoke, pets, cooking, and mold and mildew, as well as the destruction of certain airborne bacteria and viruses. While ozone can be harmful to humans in very high concentrations, air cleaners operating within the voltage levels described above generally produce ozone at concentrations well below the commonly recommended concentration of 50 parts-per-billion (ppb), generally testing at a rate of no more than 10 ppb at their highest settings. That the rate of ozone production may vary, however, and ozone production is not an important aspect of the invention.

While not necessary to the invention, certain of the electrical components that make up the power supply circuitry 200 of this embodiment are relatively heavy and are positioned near the bottom of the housing 100 to help lower the center of gravity of the air cleaner 1 and reduce the possibility that it might tip over.

In this embodiment, air cleaner 1 includes a fan 400. The fan 400 of this embodiment includes a motor (not shown), a vane unit 410, and a scroll 420. Other types of fans 400 can be used, however, including scroll-less arrangements. The motor of this embodiment, powered by the low voltage direct current generated by the power supply circuitry 200, is configured to rotate the vane unit 410 by means of a shaft (also not shown) which directly connects the motor and the vane unit 410. When rotating, the vane unit 410 moves air up through the body of the air cleaner 1 and channels it along the inside of the scroll 420, such that the air is expelled through scroll opening 425. Scroll opening 425 is in registration with air outlets 140, such that the air channeled through the scroll opening 425 is expelled from the air cleaner 1.

The rate at which the fan 400 draws air through the unit must be tailored for the particular electrodes, housing, and voltages of a given embodiment The fan 400 may have a single speed, a number of fixed speeds, or variable speeds. In the illustrated embodiment, air flow rates of between 0 and approximately 12 cubic feet per minute (cfm) have been found effective, with a rate of approximately 8 cfm being preferred at the preferred voltage differential of approximately 14,000 volts.

The fan 400 of this embodiment is located between the collector 310 and the air outlets 140. As noted, however, this need not be the case, as the fan 400 can be positioned in any location suitable for moving air past the collector 310. In certain embodiments, for example, the fan can be located between the air inlet 130 and the collector 310, between the air outlet 140 and the collector 310, or even in the center of the collector 310 such that it might draw air through the collector 310. In still other embodiments, the fan 400 need not be located in the housing 100 at all. Of course, the fan 400 may contain more than one vane unit 410 and/or scroll 420, and it may be driven by more than one motor.

In this embodiment, the air cleaner 1 includes a collector electrode 310 and a plurality of discharge electrodes 360 that cooperate to remove particulate matter contained in air that is moved through the unit by the fan 400.

Figure 8:
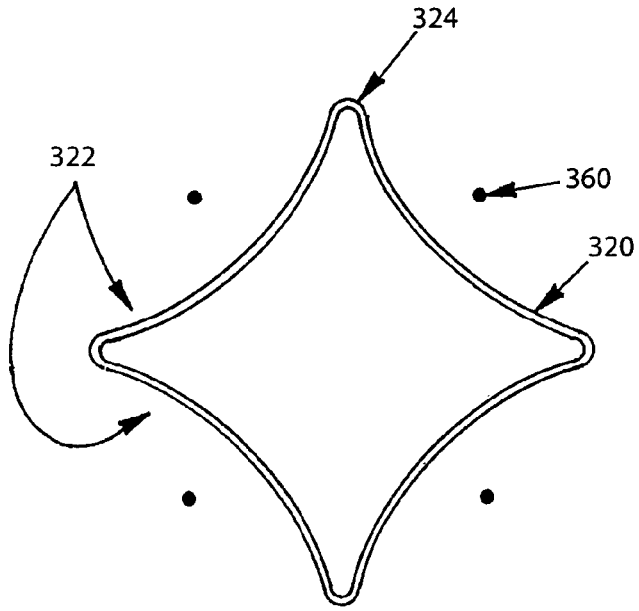
FIG. 8 is a partial cross-sectional view of the collector and discharge electrodes of the FIG. 3 air cleaner.
Figure 3:
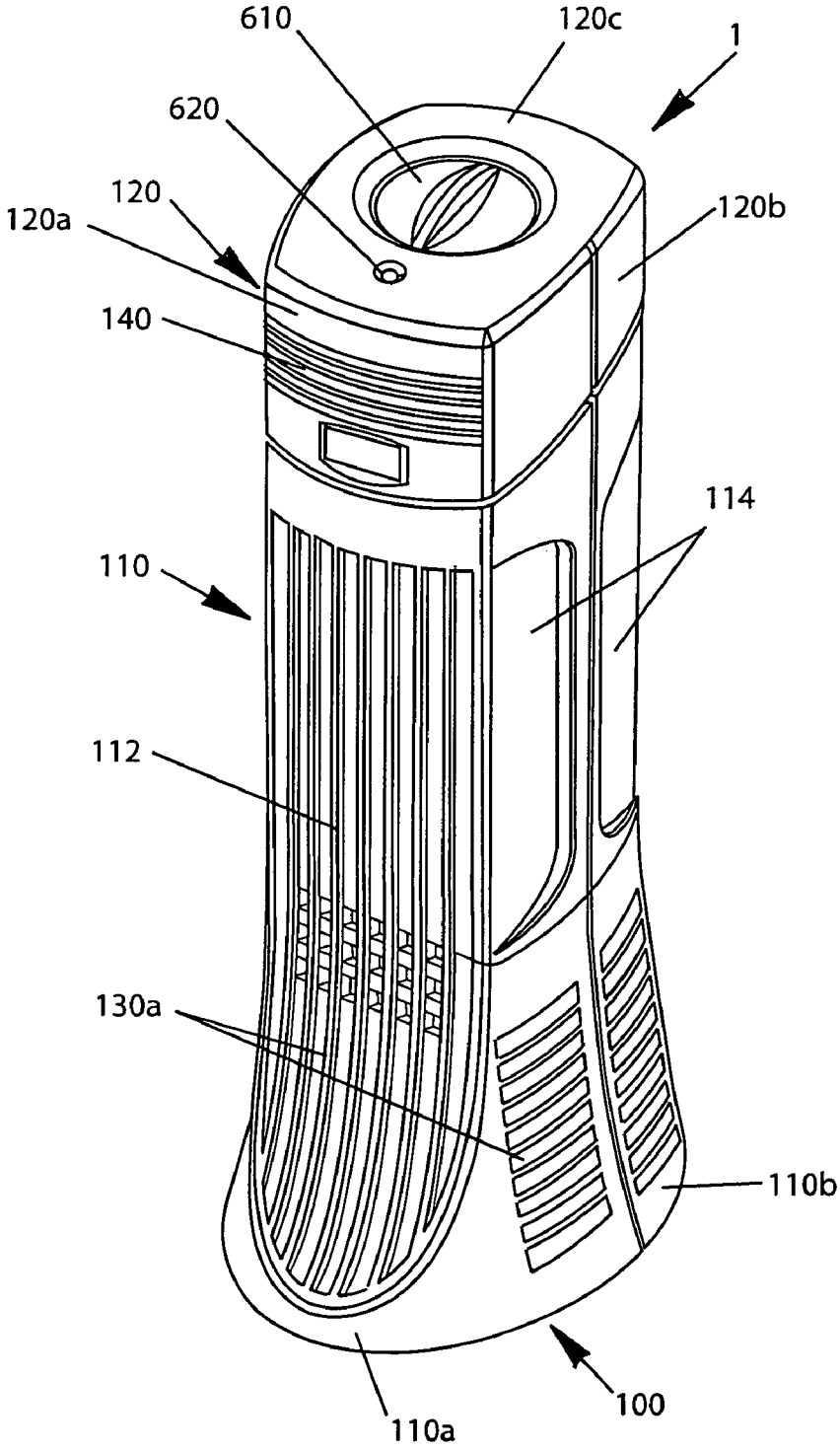
FIG. 3 is a front perspective view of one embodiment of an air cleaner in accordance with an aspect of the invention.
Figure 4:
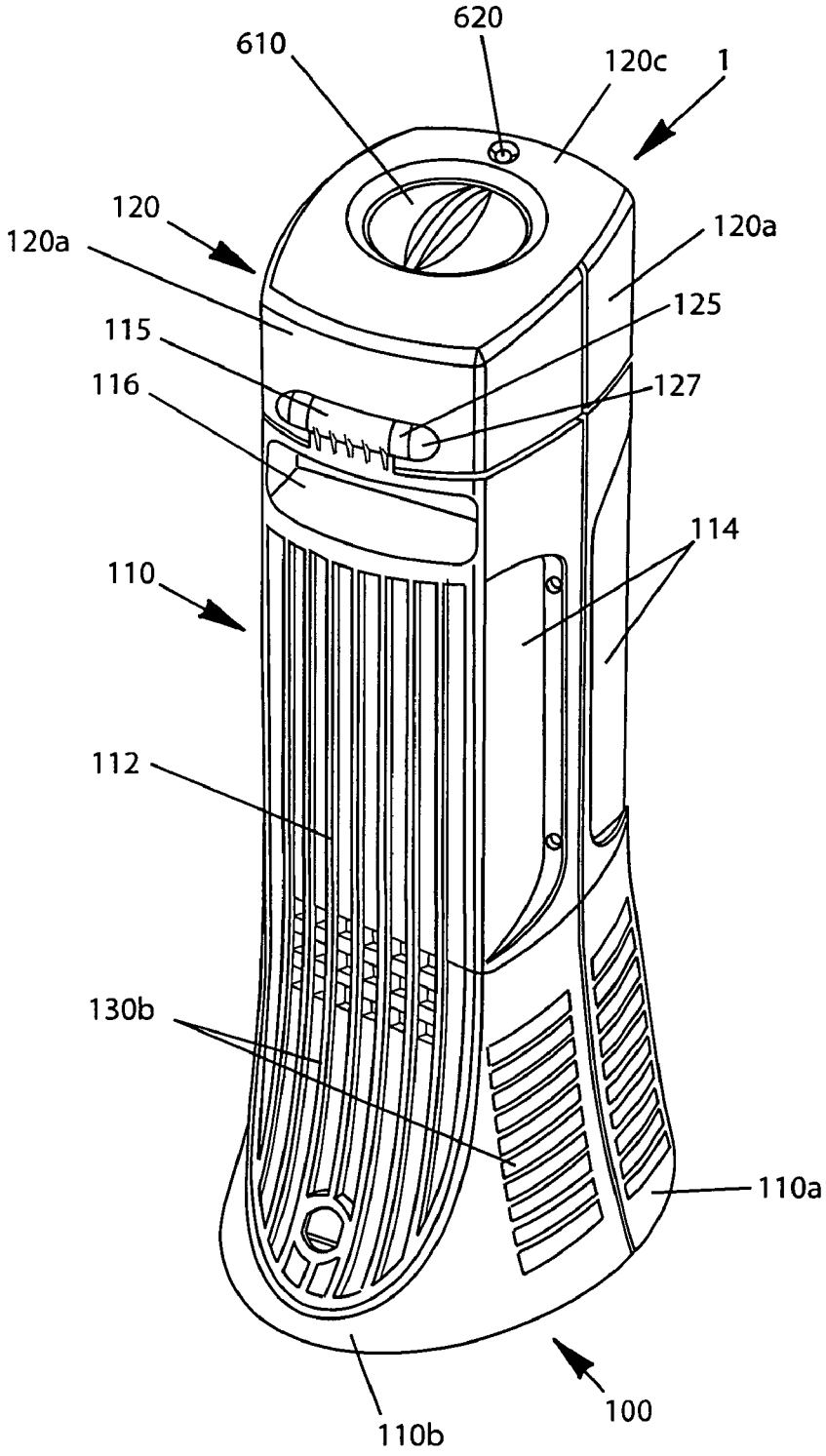
FIG. 4 is a rear perspective view of the FIG. 3 air cleaner.
Figure 7:
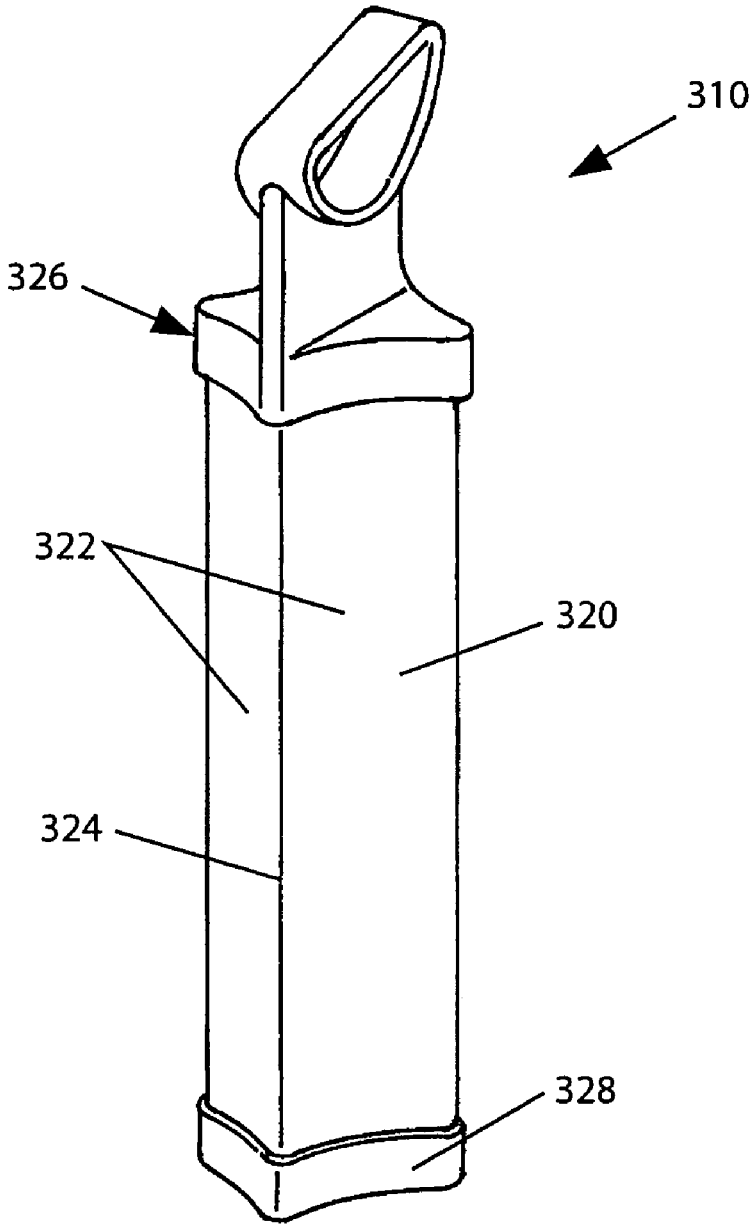
FIG. 7 is a perspective view of the collector of the FIG. 3 air cleaner.

The collector 310 of the illustrated embodiment, shown in FIGS. 6–8, includes a collector body 320 that can be removed from the air cleaner 1 for cleaning or replacement. While the collector body 320 of this embodiment is a monolithic structure made of extruded 6061 aluminum, in other embodiments it may be made of several individual pieces and may be made of any suitable conductive material, including, for example, steel, tungsten, or brass. The collector body 320 may be manufactured by any appropriate method, including extrusion, casting, roll forming, etc. In the illustrated embodiment, the collector body 320 is a hollow structure with a wall thickness of approximately 0.70 mm. Although the hollow wall construction reduces the cost and weight of the collector 310, it should be understood that it is not critical to the invention and that the collector body 320 could be a solid structure or could have walls of any suitable thickness. The collector body 320 of this embodiment is approximately 190 mm in length, although a portion of that length is covered by the handle 326 and the base 328, as described below.

As can be seen most clearly in FIG. 8, the collector body 320 of the embodiment has a cross-section that resembles a square with rounded corners and its sides pinched evenly inwards. The pinched sides form four concave faces 322 with constant, uniform radii. The distance from the outside center of one face 322 to the outside center of the opposite face 322 is approximately 34 mm, and each curved face has a radius of approximately 40 mm. The corners 324 of the collector body 320 have a radius of approximately 1.8 mm. In some embodiments, the surface of the collector body may be coated with appropriate substances to, for example, inhibit oxidation or facilitate cleaning.

As noted, the invention is not limited to the particular collector body 320 of the illustrated embodiment. Rather, the collector body 320 can be any suitable width and length and can have any appropriate number of faces 322. The collector body 320 could also be perforated such that air could pass through its walls. In such an arrangement, the air cleaner 1 could be configured such that the fan 400 would draw air through the walls of the collector electrode 320 and then up or down through the hollow center and out of the air cleaner 1. The faces 322 of the collector body 320 need not have constant radii, need not all have the same radii, and, in some embodiments, may not be radiused at all, instead having any number of flat sub-faces, including one. The faces 322 also need not cover the entire surface of the collector electrode 310 and, in some embodiments, the faces may simply be theoretical segments of a smooth surface such as a cylinder.

The collector 310 of this embodiment has a handle 326 into which the top of the collector body 320 fits. The handle 326 facilitates removal of the collector 310 from the air cleaner 1 and covers what might otherwise be sharp top edges of the collector body 320. The collector also has a base 328 which serves to cover any sharp lower edges of the collector body 320. As seen in FIG. 6, this embodiment also includes upper plate 330 and lower plate 340, which serve to anchor the discharge electrodes 360. The handle 326 and base 328 also seat against upper plate 330 and lower plate 340 to prevent the collector from moving or rattling when the collector is installed in the air cleaner 1.

The discharge electrodes 360 of the illustrated embodiment are a series of four wires strung approximately parallel to each other and spaced evenly around the collector 310, such that each wire is centered in and parallel to one face 322 of the collector body 320. The discharge electrodes 360 are strung between the upper plate 330 and the lower plate 340 and pass through the lower plate 340, where they are brought into electrical contact with the positive high voltage output of the power supply circuitry 200. The discharge electrodes 360 are tungsten wires with approximately uniform diameters of approximately 0.2 mm that are strung to a tension of approximately 100 grams. The longitudinal axes of the four discharge electrodes 360 are located approximately 15 mm from the outside center of the corresponding face 322.

Of course, the invention is not limited to the discharge electrode arrangement of the illustrated embodiment. In particular, numbers of electrode wires other than four may be used. Additional wires might be appropriate in the case of a larger collector 310, while fewer wires might be appropriate in the case of a smaller collector 310. In some embodiments, the discharge electrodes 360 may be a single wire that runs from one end of the collector 310 to the other two or more times. Other types of material may be used for the discharge electrodes 360, such as steel, brass, aluminum, or any other electrically conductive substance and, in some embodiments, the surface of the discharge electrodes 360 may be coated with appropriate substances to, for example, inhibit oxidation or facilitate cleaning. Other diameters of wire may be employed and, in fact, the discharge electrodes 360 may be structures other than wires, including, for example, structures with elongated, "V"-shaped, or "U"-shaped cross sections. In addition, the spatial relationship between the discharge electrodes 360 and the collector body 320 may be varied, as some or all of the discharge electrodes 360 may be closer to or further from the collector 320. In some embodiments, some or all of the discharge electrodes may not be centered in or parallel to the corresponding face 322.

The air cleaner 1 of this embodiment includes a discharge electrode cleaner. The discharge electrode cleaner of this embodiment includes two shuttles 510 that each ride on two discharge electrodes 360 and on one rib 520. The use of shuttles 510 to clean the discharge electrodes 360 protects the delicate discharge electrodes and prevents the user from coming into contact with potentially high residual voltages.

Figure 9:
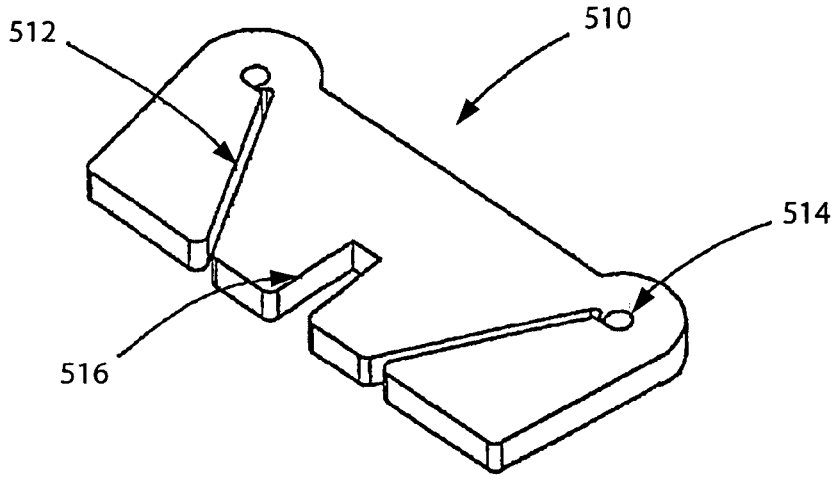
FIG. 9 is a perspective view of a cleaning shuttle of the FIG. 3 air cleaner.

Shown most clearly in FIG. 9, the loose shuttles 510 of this embodiment are flat and made of non-conductive plastic. The shape and composition of the shuttles 510 is, however, not critical to the invention. The shuttles 510 may be of any suitable shape and may be made of any appropriate material, although preferably they are made of a material that is mechanically durable and can withstand high voltages and/or temperatures. In addition, the shuttles 510 may ride on differing numbers of discharge electrodes 360, including all or one. Where the shuttles 510 each ride on a single discharge electrode, they also may be bead-shaped.

The shuttles 510 of this embodiment have electrode slots 512 that are adapted to fit around the discharge electrodes 360 and are sized such that the shuttles 510 can easily slide up and down the discharge electrodes 360. While the electrode slots 512 of this embodiment are tapered away from the center of the shuttle 510 and have offset ends 514, so as to help the shuttles 510 stay on the discharge electrodes 360, this arrangement is not critical to the invention. The ability of the shuttle to stay on the discharge electrodes may also be improved by constructing the electrode slots 512 to fully encircle the discharge electrodes 360 (particularly where the shuttle rides on only one discharge electrode 360) and/or by arranging the shuttle 510 to ride on additional discharge electrodes 360.

The shuttles 510 may be any color and have any surface decoration or textures. In some embodiments, the shuttles 510 have a textured surface or coating on the walls of the electrode slots 512 and/or offset ends 514 to enhance their ability to ride on or strip debris from the discharge electrodes 360. Other materials or substances adhered to the walls of the electrode slots 512 and/or offset ends 514 may also serve this function.

The shuttles of the illustrated embodiment are made of molded ABS plastic, are approximately 58 mm wide, 25 mm deep, 2.5 mm thick, and weigh approximately 3.37 grams. Of course, shuttles of different sizes and weights could be used, depending on, among other things, the size, number, shape, and arrangement of the discharge electrodes 360.

The ribs 520 of this embodiment are elongated ABS plastic structures that are arranged approximately in parallel with the discharge electrodes 360 and fit against the inside of the housing 100. The ribs 520 have elongated fins 525 that are adapted to fit loosely into a rib slot 516 on one or more of the shuttles 510. The structure and composition of the ribs 520 is not critical; they can be shaped as illustrated, they can have any other suitable shape, including rod- or wire-like shapes, and they can be made of any suitable material. The ribs 520 can be integral to, attached to, or separate from the housing 100. In some embodiments, the ribs are unnecessary.

The shuttles 510 of this embodiment rest against the lower plate 340 during normal operation of the unit and are loosely retained in that location by the presence of the collector 310. When the collector 310 is removed from the unit, such as for cleaning, the shuttles 510 may be moved up and down on the discharge electrodes 360 upon inversion, rotation, or shaking of the air cleaner 1. As the shuttles move up and down on the discharge electrodes 360, the walls of the electrode slots 512 and/or offset ends 514 scrape accumulated particles and other matter from the surfaces of the discharge electrodes 360.

To facilitate easy removal of the collector electrode 310, the illustrated embodiment of the air cleaner 1 also includes a leaf-type contact 350 that connects the high voltage output of the power supply circuitry 200 to the collector body 320. The leaf-type contact 350 is mounted to the lower plate 340 such that the collector body 320 touches and depresses the leaf portions of the leaf-type contact 350 when the collector 310 is inserted into the air cleaner 1. When the collector 310 is fully inserted into the air cleaner 1, the spring-like leaves maintain firm contact with the collector body 320, thereby providing a reliable electrical path between the collector body 320 and the high voltage output of the power supply circuitry 200. While the leaf-type contact 350 of the illustrated embodiment touches the inserted collector body 320 at two points, contact could be made at more or fewer locations. Although the leaf-type contact 350 is particularly effective at providing a durable, removable connection to the collector 310, it is not critical to the invention and other methods of connection, such as a coil-type spring or conductive foam, can be used.

In another aspect of this embodiment, the air cleaner 1 includes controls that permit a user to control the operation of the air cleaner 1. The controls may allow a user to turn the air cleaner 1 on and off, select a fan speed, select an electrode voltage differential, and/or control any other appropriate setting. In the illustrated embodiment, the controls includes a control knob 610, which permits the user to turn the air cleaner 1 on and off and allows adjustment of the fan speed, as well as a light 620 that indicates whether the air cleaner 1 is or is not on. It should be appreciated, however, that the controls may include any suitable input or display mechanisms, such as indicator lights, switches, buttons, sliders, touch screens, timers, and/or any other appropriate electric and/or mechanical devices. A timer, for example, may allow the air cleaner 1 to operate for a given period of time and then shut off automatically. In some embodiments, the controls may include a night light. In addition, in some embodiments, the air cleaner 1 may be operated by a remote device such as a wired or wireless remote control.

While the invention has been described on conjunction with specific embodiments, many alternatives, modifications and variations will be apparent to those skilled in the art. Accordingly, embodiments set forth herein are intended to be illustrative of the various aspects of the invention, not limiting. Various changes may be made without departing from the spirit and scope of the invention.

We claim:

1. An electrode cleaning assembly comprising:

a housing;

a collector electrode;

a plurality of elongated discharge electrodes arranged in the interior of the housing;

an elongated rib projecting into the interior of the housing;

at least one cleaning shuttle that is configured to move along and remove debris from at least one of the elongated discharge electrodes, wherein the cleaning shuttle has a first slot configured to ride on the elongated rib and second and third slots configured to ride on and remove debris from the elongated discharge electrodes, wherein the second and third slots are inclined toward each other; and wherein the cleaning shuttle is substantially flat and is constructed and arranged to move independently of the housing and the collector electrode.

2. The electrode cleaning assembly of claim 1, wherein the cleaning shuttle is configured to move along and remove debris from at least two of the elongated discharge electrodes.

3. The electrode cleaning assembly of claim 1, wherein the at least one cleaning shuttle fully encircles the elongated discharge electrode, and the cleaning shuttle is bead or disk shaped.

4. The electrode cleaning assembly of claim 1, wherein an inner wall of the second and third slots comprises a textured surface or coating to enhance the ability of the slots to move along and remove debris from the elongated discharge electrodes.

5. The electrode cleaning assembly of claim 1, wherein the second and third slots are configured such that they fit loosely on the elongated discharge electrode.

6. The electrode cleaning assembly of claim 1, wherein an inner wall of the second and third slots is configured to scrape accumulated particles and matter from the surfaces of the at least one elongated discharge electrode.

7. An electrode cleaning assembly comprising:

a housing having an air inlet and an air outlet;

a fan arranged to draw air in through the air inlet and expel air out through the air outlet;

a collector electrode disposed between the air inlet and the air outlet;

a plurality of discharge electrodes arranged in the interior of the housing;

an elongated rib projecting into the interior of the housing;

at least one cleaning shuttle that is configured to move along and remove debris from at least two of the electrodes, wherein the cleaning shuttle has a first slot configured to ride on the elongated rib and second and third slots configured to ride on and remove debris from the elongated discharge electrodes, wherein the second and third slots are inclined toward each other; and wherein the cleaning shuttle is substantially flat and is constructed and arranged to move independently of the housing and the collector electrode.

8. The electrode cleaning assembly of claim 7, wherein the plurality of discharge electrodes are arranged such that a straight line can be constructed from at least one discharge electrode to at least one other discharge electrode such that a line passes through the collector electrode.

9. The electrode cleaning assembly of claim 7, further comprising:

electrical circuitry configured to provide a first voltage level to the discharge electrodes and a second voltage level, different from the first voltage level, to the collector electrode.

10. The electrode cleaning assembly of claim 7, wherein the collector electrode is elongated and has at least one distinct face which corresponds to one of the discharge electrodes.

11. The electrode cleaning assembly of claim 7, wherein a longitudinal axis of the at least one discharge electrode is located approximately 15 millimeters from a longitudinal center line of the distinct face corresponding to the at least one discharge electrode.

12. The electrode cleaning assembly of claim 7, wherein the collector electrode is hollow and air flows through perforations in the collector electrode.

13. The electrode cleaning assembly of claim 7, wherein the discharge electrodes are elongated and have an approximately circular cross-section.

14. The electrode cleaning assembly of claim 7, wherein the cleaning shuttle is configured to remove debris from at least two of the discharge electrodes.

15. The electrode cleaning assembly of claim 9, wherein the first voltage level is between approximately 3,000 volts and approximately 20,000 volts.

16. The electrode cleaning assembly of claim 9, wherein the difference between the first and second voltage levels is between approximately 3,000 volts and approximately 40,000 volts.

17. The electrode cleaning assembly of claim 9, wherein the difference between the first and second voltage levels is variable.

18. The electrode cleaning assembly of claim 7, further comprising a set of controls positioned on the housing to allow a user to control operation of the air cleaner.

19. The electrode cleaning assembly of claim 7, wherein the fan may be operated at least two different speeds.

20. The electrode cleaning assembly of claim 7, wherein the collector has a closed cross-section.

21. The electrode cleaning assembly of claim 7, wherein the collector electrode is elongated and the fan is arranged to move air along the length of the collector electrode.

22. The electrode cleaning assembly of claim 7, further comprising a mechanical air filter element arranged to filter air passing though the housing.

23. The electrode cleaning assembly of claim 7, further comprising an ultra-violet light arranged to treat air passing through the housing.

24. The electrode cleaning assembly of claim 7, wherein the housing is constructed to mate with an ordinary household vacuum cleaner.

25. The electrode cleaning assembly of claim 7, wherein the air cleaner has only one collector electrode.

26. The electrode cleaning assembly of claim 7, further comprising a remote control constructed and arranged to operate the air cleaner remotely.

27. An electrode cleaning assembly comprising:

a housing having an air inlet and an air outlet;

a collector electrode;

a plurality of elongated discharge electrodes arranged in the interior of the housing;

an elongated rib projecting into the interior of the housing at least one cleaning shuttle that is configured to move along and remove debris from at least one of the elongated discharge electrodes, wherein the cleaning shuttle has a first slot configured to ride on the elongated rib and second and third slots configured to ride on and remove debris from the elongated discharge electrodes, wherein the second and third slots are inclined toward each other;

wherein the cleaning shuttle is substantially flat and is constructed and arranged to move independently of the housing and the collector electrode; and said air inlet and outlet are configured to permit air to flow from one of a top portion and a bottom portion of the housing to the other of the top portion and the bottom portion of the housing along the length of the collector and discharge electrodes.

28. An electrode cleaning assembly comprising:

a housing having an air inlet and an air outlet;

an elongated collector electrode disposed between the air inlet and the air outlet;

a fan arranged to draw air in through the air inlet and expel air out through the air outlet and to move air along the length of the collector electrode;

a plurality of discharge electrodes arranged in the interior of the housing;

an elongated rib projecting in to the interior of the housing;

at least one cleaning shuttle that is configured to move along and remove debris from at least two of the electrodes, wherein the cleaning shuttle has a first slot configured to ride on the elongated rib and second and third slots configured to ride on and remove debris from the elongated discharge electrodes, wherein the second and third slots are inclined toward each other; and wherein the cleaning shuttle is substantially flat and is constructed and arranged to move independently of the housing and the collector electrode.

* * * * *